United States Patent [19]

Jones

[11] 4,005,029

[45] * Jan. 25, 1977

[54] LAUNDERING ADJUNCT

[75] Inventor: J. Paul Jones, Springfield Township, Ohio

[73] Assignee: The Procter & Gamble Company, Cincinnati, Ohio

[ * ] Notice: The portion of the term of this patent subsequent to Feb. 1, 1994, has been disclaimed.

[22] Filed: Mar. 10, 1976

[21] Appl. No.: 665,475

Related U.S. Application Data

[63] Continuation of Ser. No. 384,529, Aug. 1, 1973, abandoned, which is a continuation-in-part of Ser. No. 230,518, Feb. 29, 1972, abandoned.

[52] U.S. Cl. ..... 252/99; 252/95; 252/102; 252/186; 252/DIG. 1; 252/DIG. 7; 8/111; 8/19

[51] Int. Cl.[2] ..... C11D 7/38; C11D 7/56

[58] Field of Search ..... 252/95, 99, 102, 186, 252/DIG. 1, DIG. 7; 8/111, 19

[56] References Cited

UNITED STATES PATENTS

| | | | |
|---|---|---|---|
| 2,749,313 | 6/1956 | Williams, Jr. | 252/186 X |
| 3,560,395 | 2/1971 | Westbrook, Jr. | 252/186 |
| 3,822,114 | 2/1974 | Montgomery | 252/99 X |

*Primary Examiner*—Mayer Weinblatt
*Attorney, Agent, or Firm*—Charles R. Wilson; Julius P. Filcik; Richard C. Witte

[57] ABSTRACT

Compositions and processes useful for inhibiting the transfer to fabric articles of solubilized or suspended dyes found in fabric laundering solutions. Such dyes are oxidized by a composition comprising a peroxygen compound, certain aldehydes and ketones, a zwitterionic surfactant and a buffer compound.

17 Claims, No Drawings

LAUNDERING ADJUNCT

CROSS-REFERENCE TO RELATED APPLICATION

This application is a continuation of Ser. No. 384,529, Aug. 1, 1973 and which is a C-I-P- of Ser. No. 230,518, Feb. 29, 1972, both now are abandoned.

BACKGROUND OF THE INVENTION

The present invention relates to compositions and processes useful for inhibiting the transfer from one fabric to another of dye released into laundering solution from colored fabrics during conventional laundering of such colored fabrics. The compositions and processes utilize in their broadest aspect a peroxygen compound, an activator compound having particular peroxygen activation effects, a zwitterionic surfactant, and a buffer compound.

One of the most persistent and troublesome problems arising during modern fabric laundering operations is the tendency of some colored fabrics to release into laundering solutions dye which is then transferred during laundering onto other fabrics being washed therewith. Heretofore, there has been no good way to combat the problem of dye transfer other than by mechanically sorting the fabrics to partition said fabrics into dark and light shades for separate laundering.

Much of the difficulty in reducing dye transfer stems from the fact that many different types of dyes are utilized to color many different types of fabrics. Common fabric dyes include direct dyes used primarily to color cotton and rayon fabrics, acid dyes used primarily on nylon fabrics, disperse dyes used primarily on polyester/cotton, polyester, nylon, and Spandex fabrics, azo dyes used primarily on cotton and nylon fabrics, and vat dyes used primarily on cotton and rayon fabrics. Direct, acid and disperse dyes are in general readily released into washing solution while azo and vat dyed fabrics bleed very little. Cotton, nylon, rayon and Spandex fabrics have a strong propensity to pick up from solution solubilized or suspended dyes while polyester/cotton and polyester fabrics pick up such dyes to a lesser extent.

Suspended or solubilized dyes of all types can to some degree be oxidized in solution by employing known chlorine, peroxygen, activated peroxygen or peroxygen-chlorine bleaching compositions in high concentrations. While such bleaches inhibit dye transfer, they also damage dyes on fabrics thereby making their use for laundering of colored fabrics undesirable. Some of the milder peroxygen and activated peroxygen bleaching formulations can be utilized during laundering of colored fabrics with minimal color damage. (Examples of such compositions are the ketone-activated peroxygen bleaching compositions disclosed in the copending U.S. patent application of Ronald E. Montgomery, Ser. No. 393,262, filed Sept. 28, 1972, now U.S. Pat. No. 3,822,114.) While compositions of these latter two types are effective for direct bleaching of fabrics and do to some extent eliminate transfer of certain solubilized or suspended dyes, there are in the average colored wash load inevitably some of the many kinds of dyes and fabrics against which such compositions are not effective for dye transfer inhibition.

Accordingly, it is an object of the present invention to provide compositions which can be added to fabric laundering solutions to eliminate the transfer of most solubilized or suspended dye from one fabric to another during washing no matter which types of dyes and fabrics are present.

It is a further object of the instant invention to provide compositions which accomplish effective dye transfer inhibition without damaging dyes on the fabrics themselves.

It is a further object of the present invention to provide dye transfer inhibition compositions which are compatible with and in fact can be made a part of conventional surfactant-containing fabric laundering detergent compositions.

It is a further object of this invention to provide a process useful for inhibiting dye transfer among fabrics in a laundering solution.

It has been discovered that by combining certain peroxygen compounds with certain activator compounds, with a zwitterionic surfactant, and with buffer compounds, compositions and processes can be realized which accomplish the above objectives and provide useful dye transfer inhibition heretofore unavailable for colored fabric laundering operations.

SUMMARY OF THE INVENTION

The present invention provides solid compositions comprising (A) from about 2% to about 75% by weight of a peroxygen compound selected from the group consisting of (1) water-soluble monopersulfates, (2) water-soluble monoperphosphates, (3) organic peroxyacids having the general formula

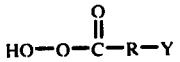

wherein R is selected from the group consisiting of alkylene groups containing from 1 to about 16 carbon atoms and arylene groups containing from about 6 to about 8 carbon atoms, and Y is hydrogen, halogen, alkyl, aryl or a group providing an anionic moiety in aqueous solution, (4) water-soluble salts of said peroxyacids and (5) mixtures thereof; (B) from about 0.2% to about 40% by weight of an aldehyde or ketone compound providing a Relative Oxidation Constant of 0.25 or greater if an inorganic persalt is used or 25 or greater if a peracid is used; (C) from about 1% to about 85% by weight of a buffering agent capable of maintaining the pH of an aqueous solution of said composition within the range of about 7 to about 12; and (D) from about 2% to about 75% by weight of a zwitterionic surfactant. A process for employing such compositions in laundering solution is also provided.

DESCRIPTION OF THE INVENTION

The present invention provides compositions which in fabric laundering solutions reduce the coloration of fabrics being laundered caused by transfer from other fabrics of solubilized or suspended dyes. Such dye transfer inhibition results when four essential composition components are present within the washing solution. Each of these composition components will be discussed in detail.

The Peroxygen Component

From about 2% to about 75% by weight of the compositions of the present invention comprises a peroxygen compound. Such compounds utilized in the instant compositions are inorganic peroxygen salts and organic peroxyacids (and water-soluble salts thereof). Any such acid or salt which in aqueous solution yields a species containing a $-O-O^{\ominus}$ moiety is operable in the present compositions and processes.

Examples of inorganic peroxygen salts include the water-soluble monopersulfates and water-soluble monoperphosphates. Specific examples of such salts include sodium monopersulfate, potassium monopersulfate, disodium monoperphosphate, dipotassium monoperphosphate, tetrapotassium peroxydiphosphate, and tetramethylammonium monopersulfate. Highly preferred peroxygen salts, i.e., those which are most highly activated by activators in the practice of the instant invention, are the sodium and potassium monopersulfates of the formulas $NaHSO_5$ and $KHSO_5$, respectively. Potassium monopersulfate is available commercially from E. I. duPont de Nemours and Company, Inc. under the tradename "Oxone". Oxone contains approximately 41.5% by weight $KHSO_5$, the balance being $KHSO_4$ and $K_2SO_4$ in about equal proportions.

Operable peroxyacids of the present invention have the general formula

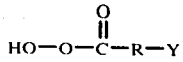

wherein R is an alkylene group containing from 1 to about 16 carbon atoms or an arylene group containing from 6 to about 8 carbon atoms and Y is hydrogen, halogen, alkyl, aryl or any group which provides an anionic moiety in aqueous solution. Such Y groups can include, for example,

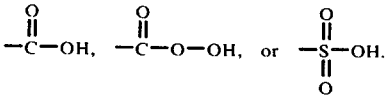

Thus the organic peroxyacids, or salts thereof, of the invention can contain either one or two peroxy groups and can be either aliphatic or aromatic.

When the organic peroxyacid is aliphatic, the unsubstituted acid has the general formula

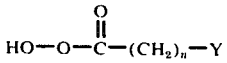

where Y, for example can be

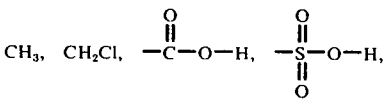

or

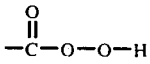

and $n$ can be an interger from 1 to 12 with perazelaic acids ($n = 7$) being the preferred compounds. The alkylene linkage and/or Y group (if alkyl) can contain halogen or other non-interfering substituents. Examples of preferred aliphatic peroxyacids include diperazelaic acid and diperadipic acid.

When the organic peroxyacid is aromatic, the unsubstituted acid has the general formula

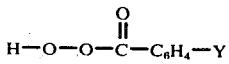

where Y is hydrogen, halogen, alkyl,

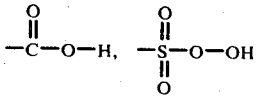

or

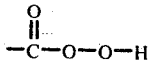

for example. The

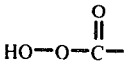

and Y groupings can be in any relative position around the aromatic ring. The ring and/or Y group (if alkyl) can contain any non-interfering substituent such as halogen groups. Examples of suitable aromatic peroxy acids or salts thereof include monoperoxyphthalic acid, diperoxyterephthalic acid, 4-chlorodiperoxyphthalic acid and the monosodium salt of diperoxyterephthalic acid. Preferred aromatic peroxyacids are m-chloroperoxybenzoic acid and p-nitroperoxybenzoic acid. A highly preferred aromatic peroxyacid is diperoxyisophthalic acid. Mixtures of the peroxygen salt compounds and the peroxyacids can be employed in the instant invention.

These peroxygen compounds are present in the instant dye transfer inhibition compositions to the extent of from about 2% to about 75% by weight, preferably from about 3% to 15% by weight. The peroxygen compounds are, of course, dissolved in aqueous laundering solutions when compositions containing them are utilized to inhibit dye transfer. In solution, the peroxygen compound should be present in a concentration sufficient to provide about 2.5 ppm to about 50 ppm available oxygen.

The Activator Component

The instant dye transfer inhibition compositions employ an aldehyde or ketone compound to activate oxidation of suspended or solubilized dyes in laundering solution by the peroxygen component.

An aldehyde is of course any compound which contains at least one carbonyl group and has two hydrogen atoms or a carbon atom and a hydrogen atom attached directly to at least one of the carbonyl carbon atoms. A ketone is any compound which contains at least one carbonyl group and has two carbon atoms attached directly to at least one of the carbonyl carbon atoms. These compounds can be aliphatic or aromatic, substituted or unsubstituted, saturated or unsaturated, or acyclic, carbocyclic or heterocyclic.

Although the scope of the present invention is not limited by any particular theory, aldehyde or ketone activation is believed to occur as follows: The peroxygen bleaches of the instant invention are believed to ionize in solution to form an anionic species having the general formula R—O—O$^{\ominus}$ wherein R, for example, can be

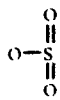

when a monopersulfate compound is used. This species will combine with the aldehyde or ketone activators of the present invention which can have, for example, the acyclic general formula

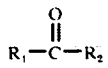

to form an intermediate of the known Baeyer-Villiger reaction. It is believed that this intermediate species has the general formula

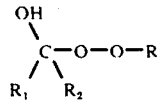

It is this species which probably oxidizes solubilized and suspended dyes in the present invention.

The activated peroxygen species, in addition to oxidizing dye, can decompose. It is thus essential that activators employed in the instant invention have chemical properties which provide peroxygen activation (i.e., formation of the active peroxygen species, and hence dye oxidation) at a rate which serves to overcome the effect of peroxygen species decomposition. Operable activators of the instant invention, thus, are those which provide an acceptably high rate of peroxygen activation. Indentification of such activators can be made by a simple test measuring the rate at which the system being tested oxidizes a standard dye material (Polar Blue).

The rate equation for Polar Blue dye oxidation is kinetically expressed as follows:

$$r_{ox} = k_1 [K] [P] [PB]$$

wherein $r_{ox}$ is the rate at which the test dye (Polar Blue) is oxidized; $k_1$ is the rate constant for the oxidation reaction; $[K]$ is the concentration of aldehyde or ketone being tested; $[P]$ is the concentration of peroxygen compound; and $[PB]$ is the concentration of Polar Blue dye being oxidized. If activator and peroxygen compound are present in amounts such that their concentrations remain essentially constant relative to that of the Polar Blue being oxidized throughout the reaction, $k_1$, $[K]$ and $[P]$ can be combined into a single oxidation rate constant, $k_{ox}$, giving a Polar Blue oxidation rate equation of:

$$r_{ox} = k_{ox} [PB]$$

wherein $k_{ox} = k_1 [K] [P]$.

In a procedure more fully described below, $k_{ox}$ is determined experimentally by measuring with a spectrophotometer the light absorbence through a Polar Blue dye solution as the Polar Blue dye therein is being oxidized by the peroxygen compound-activator system being tested. A plot of the logarithm of light absorbence versus time theoretically yields a straight line, the slope of which is $k_{ox}$.

In order to precisely define the aldehydes and ketones which operate to activate the peroxygen compounds of the instant invention, a standard DYE OXIDATION RATE DETERMINATION is utilized to determine which activators have the requisite peroxygen activation characteristics. The DYE OXIDATION RATE DETERMINATION employing the general principles outlined above, is established as follows:

The oxidation rate constant ($k_{ox}$) determination is made with a water solution containing Oxone (41.5% $KHSO_5$), the activator being tested, and Polar Blue dye. The Polar Blue utilized in Polar Brilliant Blue GAW (marketed by the Geigy Chemical Corporation) which has been recrystallized from acetone/methyl alcohol/-benzene. Four grams of Polar Brilliant Blue GAW is stirred at room temperature for about 1 hour in 400 milliliters of acetone plus 400 milliliters of methyl alcohol. This solution is then filtered through Whatman 40 paper. Benzene (1600 milliliters) is added with stirring to the filtrate, and this mixture is stored at 34° F for 24 hours. The solution is then filtered at 34° F through Whatman 40 paper and the precipitate dried at room atmosphere. About 20% yield of recrystallized Polar Blue product is obtained.

An appropriate volume of deionized and doubly distilled water to yield a final volume of 100 milliliters and 5 milliliters of an 0.10 wt.% Polar Blue (as prepared above) solution are placed in a 150 milliliter glass beaker. Oxone is added to the beaker as a solid or from a stock solution to provide an Oxone concentration of $2.7 \times 10^{-3}$M, and 0.5N NaOH is added to adjust the solution pH to 9. (This pH is maintained throughout the test by periodic addition of 0.5N NaOH). At zero time, the aldehyde or ketone to be tested is added to the mixture as a solid, neat or stock solution to yield a final aldehyde or ketone concentration of $6.8 \times 10^{-3}$M or lower. (Activator solutions are generally aqueous but activators of low water solubility can be added as ethanol solutions.)

Aliquots are withdrawn for absorbence readings immediately before the addition of activator (Time 0) and at appropriate intervals thereafter (usually 30 second intervals). Absorbence readings of the aliquots are made with any commercial spectrophotometer, measured at the $\lambda_{maximum}$ for Polar Blue (6200A). The sampling continues until solution absorbence has been reduced to one half or less of its original value. After the absorbence readings are made, the samples are returned to the bulk solution. The test is run at room temperature of approximately 75° F.

At the completion of the test, a plot is made of ln absorbence vs. time. An approximate straight line resulting from this plot shows the reaction to be first order so that the oxidation rate constant can be calculated from the equation $$k_{ox} = \frac{\Delta\,(\text{Ln Absorbence})}{\Delta\, t}\ \text{sec}^{-1}.$$

The rate constant, $k_{ox}$, is approximately directly proportional to the concentration of activator present. Some ketones which are efficient activators are more effectively tested at lower concentrations than the 6.8

$\times 10^{-3}$M activator solution concentration specified above as an upper limit for use in the test. Such activators will, of course, oxidize dye at this higher specified concentration, but so quickly that absorbence measurements are difficult. Accordingly, those activators having relatively high $k_{ox}$'s are tested at activator concentrations lower than $6.8 \times 10^{-3}$M with $k_{ox}$ at this standard concentration being determined by linear extrapolation.

It is, of course, possible to obtain numerical values for $k_{ox}$ for any given activator according to the above-described DYE OXIDATION RATE DETERMINATION and limitations on $k_{ox}$ itself can be used to define operable activators of the instant invention. In order to avoid, however, possible variations in absolute $k_{ox}$ values due to imprecision in Polar Blue preparation and/or reagent concentration or quality from test to test, operable activators of the instant invention are defined in terms of a parameter $K_{ox}$, hereinafter referred to as the "Relative Oxidation Constant." $K_{ox}$ is simply defined as $$\frac{k_{ox\text{-}test}}{k_{ox\text{-}ac}}$$

wherein $k_{ox\text{-}test}$ is the numerical $k_{ox}$ obtained for the activator being tested in the above-described DYE OXIDATION RATE DETERMINATION at an actual or extrapolated activator concentration of $6.8 \times 10^{-3}$M, and $k_{ox\text{-}ac}$ is the numerical $k_{ox}$ obtained in the same manner for a standard activator, acetone, at the standard concentration of $6.8 \times 10^{-3}$M.

For purposes of the instant invention, operable activators for persalt systems of the instant invention include those aldehydes and ketones which produce a Relative Oxidation Constant ($K_{ox}$) of 0.25 or greater. Preferably, persalt activators include aldehydes or ketones which produce a $K_{ox}$ of 5.0 or greater; highly preferred aldehyde and ketone persalt activators produce a $K_{ox}$ or 25.0 or greater. Operable activators for peracid systems of the instant invention include those aldehydes and ketones which produce a Relative Oxidation Constant ($K_{ox}$) of 25.0 or greater. Preferable peracid activators include aldehydes and ketones which produce a $K_{ox}$ of 200.0 or greater.

The following tables provide representative, but not exclusive, examples of various types of activators which are operable in the instant invention. Provided for each activator is the $k_{ox}$ obtained by the DYE OXIDATION RATE DETERMINATION at an actual or extrapolated activator concentration of $6.8 \times 10^{-3}$M and the Relative Oxidation Constant, $K_{ox}$.

One class of activators consists of aldehydes having the requisite dye oxidation characteristics. Table 1 provides representative aldehyde examples.

Table 1

| Aldehyde | $k_{ox} \times 10^3$ (sec$^{-1}$) | $K_{ox}$ |
|---|---|---|
| Chloral Hydrate | 79.0 | 32.0 |
| Acetaldehyde | 22.0 | 8.8 |
| Butyraldehyde | 15.0 | 6.0 |
| Benzaldehyde | 7.7 | 3.1 |
| 4-Trimethylammonio Benzaldehyde Methyl Sulfate | 180.0 | 72.0 |

Another operable class of activator compounds is that of aliphatic ketones. Table 2 provides representative examples of aliphatic ketones having the requisite dye oxidation characteristics.

TABLE 2

| Aliphatic Ketone | $k_{ox} \times 10^3$ (sec$^{-1}$) | $K_{ox}$ |
|---|---|---|
| Trimethylammonio-acetone nitrate | 53.0 | 21.0 |
| 5-Diethylbenzylammonio-2-pentanone nitrate | 40.0 | 16.0 |
| 5-Diethylmethylammonio-2-pentanone nitrate | 38.0 | 15.0 |
| Methyl Pyruvate | 47.0 | 19.0 |
| Diethyl keto malonate | 22.0 | 8.8 |
| 3-Hydroxy-2-butanone | 20.0 | 8.0 |
| Acetol | 14.0 | 5.6 |
| Hexachloroacetone | 8.2 | 3.3 |
| 2,5-Hexanedione | 6.3 | 2.5 |
| Phenylacetone | 4.5 | 1.8 |
| Ethyl Levulinate | 2.8 | 1.1 |
| 5-Hydroxy-2-pentanone | 2.8 | 1.1 |
| Acetone | 2.5 | 1.0 |
| 3-Penten-2-one | 2.0 | 0.80 |
| Methyl Ethyl Ketone | 1.8 | 0.72 |
| 4-Hydroxy-3-methyl-2-butanone | 1.1 | 0.44 |
| 3-Pentanone | 0.80 | 0.32 |
| 2-Heptanone | 0.66 | 0.26 |

Another operable class of activator compounds is that of aromatic ketones. Table 3 provides representative examples of aromatic ketones which have the requisite dye oxidation characteristics.

Table 3

| Aromatic Ketone | $k_{ox} \times 10^3$ (sec$^{-1}$) | $K_{ox}$ |
|---|---|---|
| 8-Hydroxyquinoline | 2000.0 | 800.0 |
| 4-Acetyl-1-methylpyridinium nitrate | 1840.0 | 740.0 |
| Di-2-pyridyl Ketone, N-oxide | 1040.0 | 420.0 |
| 2-Acetylquinoxaline | 120.0 | 48.0 |
| 2-Acetyl-3-methylquinoxaline | 38.2 | 15.0 |
| Di-2-pyridyl ketone | 79.0 | 32.0 |
| 6-Acetyl-1,2,4-trimethylquinolinium nitrate | 57.0 | 23.0 |
| 8-Hydroxyquinoline, N-oxide | 55.0 | 22.0 |
| 3-Trimethylammonio-acetophenone nitrate | 49.0 | 20.0 |
| Methyl phenyl glyoxalate | 45.0 | 18.0 |
| N-Methyl-p-morpholinio-acetophenone methylsulfate | 16.0 | 6.4 |
| 3-Acetyl pyridine, N-oxide | 41.0 | 16.0 |
| p-Nitroacetophenone | 13.0 | 5.2 |
| m-Nitroacetophenone | 38.0 | 15.0 |
| Sodium p-acetyl benzene sulfonate | 1.5 | 0.60 |
| P-Acetylbenzonitrile | 5.0 | 2.0 |
| 3,5-Dinitroacetophenone | 65.0 | 26.0 |
| 4-Trimethylammonioacetophenone nitrate | 32.0 | 13.0 |
| 4-Methoxy-3-nitroacetophenone | 11.0 | 4.4 |
| p-Chloroacetophenone | 0.96 | 0.38 |
| p-Diacetylbenzene | 6.1 | 2.4 |
| N-Methyl-p-morpholinio-acetophenone nitrate | 42.0 | 17.0 |
| Phenacyltriphenylphosphonium nitrate | 7.2 | 2.9 |
| 2-Acetyl pyridine | 19.0 | 7.6 |
| 2-Acetyl pyridine, N-oxide | 12.0 | 4.8 |
| 3-Acetyl pyridine | 5.9 | 2.4 |
| 4-Acetyl pyridine | 31.0 | 12.0 |
| 4-Acetyl pyridine, N-oxide | 34.0 | 14.0 |
| 2,6-Diacetyl pyridine | 31.0 | 12.0 |
| 3-Acetyl pyridine, N-oxide | 41.0 | 16.0 |
| Triacetylbenzene | 44.0 | 18.0 |

Another operable class of activator compounds is that of cyclic ketones. Table 4 provides representative examples of cyclic ketones which have the requisite dye oxidatin characteristics.

Table 4

| Cyclic Ketone | $k_{ox} \times 10^3$ ($sec^{-1}$) | $K_{ox}$ |
|---|---|---|
| Cyclohexanone | 22.0 | 8.8 |
| 2-Methyl cyclohexanone | 5.3 | 2.1 |
| 2,6-Dimethyl cyclohexanone | 0.68 | 0.27 |
| 3-Methyl cyclohexanone | 16.0 | 6.4 |
| 4-Ethyl cyclohexanone | 27.0 | 11.0 |
| 4-t-Butyl cyclohexanone | 36.0 | 14.0 |
| 4,4-Dimethyl cyclohexanone | 39.0 | 16.0 |
| Methyl 4-oxo-cyclohexane carboxylate | 62.0 | 25.0 |
| Sodium 4-oxo-Cyclohexane carboxylate | 17.0 | 6.8 |
| 2-Trimethylammonio-cyclohexanone nitrate | 11.0 | 4.4 |
| 4-Trimethylammonio-cyclohexanone nitrate | 1840.0 | 740.0 |
| 3-oxo-Cyclohexyl acetic acid | 14.0 | 5.6 |
| Cycloheptanone | 1.2 | 0.48 |
| 1,4-Cyclohexanedione | 77.0 | 31.0 |
| Dehydrocholic acid | 120.0 | 48.0 |
| Tropinone methonitrate | 1680.0 | 670.0 |
| N-Methyl-3-oxoquinuclidinium nitrate | 1360.0 | 544.0 |

Another class of operable activator compounds is that of heterocyclic ketones. Representative examples of heterocyclic ketones having the requisite dye oxidation characteristics are shown in Table 5.

Table 5

| Heterocyclic Ketone | $k_{ox} \times 10^3$ ($sec^{-1}$) | $K_{ox}$ |
|---|---|---|
| 1,1-Dimethyl-3-oxopiperidinium nitrate | 2000.0 | 800.0 |
| 1,1-Dimethyl-4-oxopiperidinium nitrate | 2320.0 | 930.0 |
| 1-Benzyl-4-piperidone methonitrate | 3760.0 | 1500.0 |
| 1-Benzyl-4-piperidone methochloride | 2000.0 | 800.0 |
| 1-t-Butyl, 1-methyl-4-oxopiperidinium nitrate | 2560.0 | 1000.0 |
| 1-(4-Dodecylbenzyl),1-methyl-4-oxopiperidinium chloride | 2640.0 | 1100.0 |
| 3-(N-Methyl-4-oxopiperidinio)-propane sulfonate | 1040.0 | 420.0 |
| 1-Allyl-1-methyl-4-oxopiperidinium chloride | 1360.0 | 540.0 |
| 1-Methyl-1-(1-naphthylmethyl)-4-oxopiperidinium chloride | 2720.0 | 1100.0 |
| 1-Methyl-1-pentamethylbenzyl-4-oxopiperidinium chloride | 2560.0 | 1020.0 |
| 2,2,6,6-Tetramethyl-4-piperidone hydrate | 240.0 | 96.0 |
| 1-Methyl-4-piperidone, N-oxide | 96.0 | 38.0 |
| N-Carbethoxy-4-piperidone | 230.0 | 92.0 |
| N,N'-Dimethyl-N,N'-phenylene-dimethylene-bis(4-oxopiperidinium nitrate | 3440.0 | 1380.0 |
| Tetrahydrothiopyran-4-one methonitrate | 1600.0 | 640.0 |
| Tetrahydrothiopyran-4-one, S,S-dioxide | 880.0 | 350.0 |
| Tetrahydrothiopyran-3-one, S,S-dioxide | 6.1 | 2.4 |

Table 5-continued

| Heterocyclic Ketone | $k_{ox} \times 10^3$ ($sec^{-1}$) | $K_{ox}$ |
|---|---|---|
| 4-Oxacyclohexanone | 220.0 | 88.0 |

All of the above-described aldehyde and ketone examples are all either commercially availble or can obviously be synthesized by the skilled artisan having before him the teaching of the prior art. Gardini et al., *J. Chem. Soc.* (C), (1970) page 929 and Lyle et al., J. *Org. Chem.*, Vol. 24 (March, 1959), page 342 are examples of such art and are hereby incorporated herein by reference.

Activators operable in the process and compositions of the instant invention can be in either liquid or solid form. Liquid compositions, however, are generally less physically and chemically stable and hence not preferred. Preferred dry compositions, of course, employ "solid" aldehyde- or ketone-yielding compounds as the activator component. A "solid" activator is one which is solid at room temperature. Not all of the activators which operate in solution to enhance peroxygen bleaching according to the instant invention are available in solid form at room temperature. Those which are solid, however, include many of the preferred activators.

A number of aldehydes and ketones which are operable in the instant invention are liquids at room temperature, but can for use in dry compositions be put in solid form by reacting them with sodium bisulfite. Synthesis of these "bisulfite addition products" is a common reaction of aldehydes and some ketones and is described, for example, on page 298 of Cram and Hammond, *Organic Chemistry*, Second Edition, (McGraw-Hill, 1964). Aldehydes and ketones which are not branched near the functional group add bisulfite ions in aqueous solution. The products ae $\alpha$-hydroxysulfonates which can be crystallized as sodium salts.

In aqueous solution at the pH's of the instant process these bisulfite compounds, i.e., $\alpha$-hydroxysulfonates, will dissolve to yield the ketone or aldehyde and bisulfite. However, because bisulfite is capable of rapidly reducing the peroxygen bleaching agent, the mole ratio of the bisulfite addition product to peroxygen bleach is preferably maintained at less than 1:1 in concentrated compositions.

Examples of aldehydes and ketones which form such solid bisulfite addition products include acetaldehyde, butryaldehyde, benzaldehyde, acetone, methyl ethyl ketone, methyl pyruvate, cyclohexanone and some substituted cyclohexanones.

As can be seen from the description above of the bisulfite addition compounds and from the recitation of certain hydroxyquinoline compounds, not all activators for use in concentrated dye transfer inhibition compositions are necessarily aldehydes or ketones in concentrated or nonaqueous form. All activators of the present invention do, however, yield an aldehyde or ketone species in aqueous solution. An essential element of the instant invention is the presence of an aldehyde or ketone species in solution to activate the particular peroxygen compounds employed. Accordingly, the term "activator", when used to describe components of the concentrated compositions of the instant invention, is used to include compounds which yield an aldehyde or ketone in aqueous solutions.

Preferred activators for use in the instant invention are the readily available di-2-pyridyl ketone, p-nitroacetophenone and triacetylbenzene.

Activators are present in the instant dye transfer inhibition compositions to the extent of from about 0.2% to about 40% by weight, preferably from about 0.3% to 5% by weight. In washing solution such activators are generally present to the extent of from about 0.0005% to 0.06% by weight.

The Buffering Component

The dye transfer inhibition process of the instant invention is carried out in aqueous solution having a pH of from about 7 to about 12. Outside this pH range, dye transfer inhibition performance falls off. The preferred pH range is from about 8 to about 10. Since an aqueous solution of the persalts or peracids of the present invention is generally acidic, it is necessary to maintain the requisite pH conditions by utilization of standard buffering agents.

A buffering agent is, of course, any non-interfering compound which can alter and/or maintain pH. For example, phosphates, carbonates, or bicarbonates which buffer within the 7–12 pH range are useful. Examples of suitable buffering agents include sodium bicarbonate, sodium carbonate, disodium hydrogen phosphate, sodium dihydrogen phosphate, sodium tripolyphosphate, or mixtures thereof. Other buffering compositions for any desired pH can be obtained by the skilled artisan from any standard chemistry handbook or textbook. Buffering agents generally comprise from about 1% to about 85% by weight of the instant concentrated dye transfer inhibiting compositions.

The Zwitterionic Component

Compositions utilizing only the peroxygen, activator, and buffering components described above will serve to inhibit transfer of a large number of dyes commonly released in the laundering solution. Some common direct dyes, however, are not susceptible to the peroxygen compound-activator-buffer combination alone. Surprisingly, it has been found that the transfer of most dyes from commercial fabrics will be prevented by incorporating a fourth component into the present composition. This component is selected from the class of materials known as zwitterionic surfactants.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfato, phosphato, or phosphono. Examples of various classes of zwitterionic surfactants operable herein are described as follows:

1. Compounds corresponding to the general formula

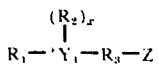

wherein $R_1$ is alkyl, alkenyl or a hydroxyalkyl containing from about 8 to about 18 carbon atoms and containing if desired up to about 10 ethylene oxide moieties and/or a glyceryl moiety; $Y_1$ is nitrogen, phosphorus or sulfur, $R_2$ is alkyl or monohydroxyalkyl containing 1 to 3 carbon atoms; $x$ is 1 when $Y_1$ is S, 2 when $Y_1$ is N or P; $R_3$ is alkylene or hydroxyalkylene containing from 1 to about 5 carbon atoms; and Z is a carboxy, sulfonate, sulfate, phosphate or phosphonate group. Examples of this class of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; (N,N-dimethyl-N-dodecylammonio)acetate; 3-(N,N-dimethyl-N-dodecylammonio)propionate; 2-(N,N-dimethyl-N-octadecylammonio)ethane-1-sulfate; 3-(P,P-dimethyl-P-dodecylphosphonio)propane-1-sulfonate; 2-(S-methyl-S-tert-hexadecylsulfonio)ethane-1-sulfonate; 3-(S-methyl-S-dodecylsulfonio)propionate, 4-(S-methyl-S-tetradecylsulfonio)butyrate; 3-(N,N-dimethyl-N-4-dodecenylammonio)propane-1-sulfonate; 3-(N,N-dimethyl-N-2-diethoxyhexadecylammonio)propane-1-phosphate; and 3-(N,N-dimethyl-N-4-glycerylodecylammonio)propionate.

Preferred compounds of this class from a commercial standpoint are 3-(N,N-dimethyl-N-hexadecylammonio)-2-hydroxypropane-1-sulfonate; 3-(N,N-dimethyl-N-alkylammonio)-2-hydroxypropane-1-sulfonate, the alkyl group being derived from tallow fatty alcohol; 3-(N,N-dimethyl-N-hexadecylammonio)propane-1-sulfonate; 3-(N,N-dimethyl-N-tetradecylammonio)-propane-1-sulfonate; 3-(N,N-dimethyl-N-alkylammonio)-2-hydroxypropane-1-sulfonate, the alkyl group being derived from the middle cut of coconut fatty alcohol; 3-(N,N-dimethyldodecylammonio)-2-hydroxypropane-1-sulfonate; 4-(N,N-dimethyl-tetradecylammonio)butane-1-sulfonate; 4-(N,N-dimethyl-N-hexadecylammonio)butane-1-sulfonate; 4-(N,N-dimethylhexadecylammonio)butyrate; 6-(N,N-dimethyl-N-octadecylammonio)hexanoate; 3-(N,N-dimethyl-N-eicosylammonio)-3-methylpropane-1-sulfonate; and 6-(N,N-dimethyl-N-hexadecylammonio)hexanoate.

Means for preparing many of the surfactant compounds of this class are described in U.S. Pat. Nos. 2,129,264, 2,774,786, 2,813,898, 2,828,332 and 3,529,521 and German Pat. No. 1,018,421 all incorporated herein by reference.

2. Compounds having the general formula:

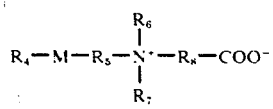

wherein $R_4$ is an alkyl, cycloalkyl, aryl, aralkyl or alkaryl group containing from 10 to 20 carbon atoms; M is a bivalent radical selected from the group consisting of aminocarbonyl, carbonylamino, carbonyloxy, aminocarbonylamino, the corresponding thio groupings and substituted amino derivatives; $R_5$ and $R_8$ are alkylene groups containing from 1 to 12 carbon atoms; $R_6$ is alkyl or hydroxyalkyl containing from 1 to 10 carbon atoms; $R_7$ is selected from the group consisting of $R_6$ groups, $R_4$—M—$R_5$—, and —$R_8$ COOMe wherein $R_4$, $R_5$, $R_6$, and $R_8$ are as defined above and Me is a monovalent salt-forming cation. Compounds of the type include N,N-bis(oleylamidopropyl)-N-methyl-N-carboxymethylammonium betaine; N,N-bis(stearamidopropyl)-N-Methyl-N-carboxymethylammonium betaine; N-(stearamidopropyl)-N-dimethyl-N-carboxymethylammonium betaine; N,N-bis(oleylamidopropyl)-N-(2-hydroxyethyl)-N-carboxymethylammonium betaine; and N-N-bis-(stearamidopropyl)-N-(2-hydroxyethyl)-N-carboxymethylammonium betaine. Zwitterionic surfactants of this type are prepared in accordance with method described in U.S. Pat. No. 3,265,719 and DAS No. 1,018,421.

3. Compounds having the general formula:

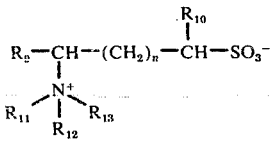

wherein $R_9$ is an alkyl group, $R_{10}$ is a hydrogen atom or an alkyl group, the total number of carbon atoms in $R_9$ and $R_{10}$ being from 8 to 16 and

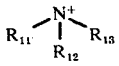

represents a quaternary ammonio group in which each group $R_{11}$, $R_{12}$ and $R_{13}$ is an alkyl or hydroxyalkyl group or the groups $R_{11}$, $R_{12}$ and $R_{13}$ are conjoined in a heterocyclic ring and n is 1 or 2. Examples of suitable zwitterionic surfactants of this type include the $\gamma$ and $\delta$ hexadecyl pyridino sulphobetaines, the $\gamma$ and $\delta$ hexadecyl $\gamma$-picolino sulphobetaines, the $\gamma$ and $\delta$ tetradecyl pyridino sulphobetaines, and the hexadecyl trimethylammonio sulphobetaines. Preparation of such zwitterionic surfactants is described in South African patent application No. 69/5788.

4. Compounds having the general formula

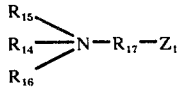

wherein $R_{14}$ is an alkarylmethylene group containing from about 8 to 24 carbon atoms in the alkyl chain; $R_{15}$ is selected from the group consisting of $R_{14}$ groups and alkyl and hydroxyalkyl groups containing from 1 to 7 carbon atoms; $R_{16}$ is alkyl or hydroxyalkyl containing from 1 to 7 carbon atoms; $R_{17}$ is alkylene or hydroxyalkylene containing from 1 to 7 carbon atoms and $Z_1$ is selected from the group consisting of sulfonate, carboxy and sulfate. Examples of zwitterionic surfactants of this type include 3-(N-dodecylbenzyl-N,N-dimethylammonio)propane-1-sulfonate; 4-(N-dodecylbenzyl-N-N-dimethylammonio)butane-1-sulfonate; 3-(N-hexadecylbenzyl-N,N-dimethylammonio)propane-1-sulfonate; 3-(N-dodecylbenzyl-N,N-dimethylammonio)propionate; 4-(N-hexadecylbenzyl-N,N-dimethylammonio)butyrate; 3-(N-tetradecylbenzyl-N,N-dimethylammonio)propane-1-sulfate; 3-(N-dodecylbenzyl-N,N-dimethylammonio)-2-hydroxypropane-1-sulfonate; 3-[N,N-di(dodecylbenzyl)-N-methylammonio]-propane-1-sulfonate; 4-[N,N-di(hexadecylbenzyl-N-methylammonino]butyrate; and 3-[N,N-di(tetradecylbenzyl)-N-methylammonio]-2-hydroxypropane-1-sulfonate.

Zwitterionic surfactants of this type as well as methods for thier preparation are described in U.S. Pat. Nos. 2,697,116; 2,697,656 and 2,669,991 and Canadian Pat. No. 883,864, all incorporated herein by reference.

5. Compounds having the general formula:

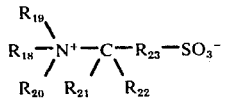

wherein $R_{18}$ is an alkylphenyl, cycloalkylphenyl or alkenylphenyl group containing from 8 to 20 carbon atoms in the alkyl, cycloalkyl or alkenyl moiety; $R_{19}$ and $R_{20}$ are each aliphatic groups containing from 1 to 5 carbon atoms; $R_{21}$ and $R_{22}$ are each hydrogen atoms, hydroxyl groups or aliphatic groups containing from 1 to 3 carbon atoms and $R_{23}$ is an alkylene group containing from 2 to 4 carbon atoms.

Examples of zwitterionic surfactants of this type include 3-(N-dodecylphenyl-N,N-dimethylammonio)-propane-1-sulfonate; 4-(N-hexadecylphenyl-N,N-dimethyl)butane-1-sulfonate; 3-(N-tetradecylphenyl-N,N-dimethylammonio)-3,3-dimethylpropane-1-sulfonate and 3-(N-dodecylphenyl-N,N-dimethylammonio)-3-hydroxypropane-1-sulfonate. Compounds of this type are described more fully in British Pat. Nos. 970,883 and 1,046,252, incorporated herein by reference.

6. Compounds having the general formula

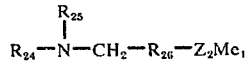

wherein $R_{24}$ is alkyl or substituted alkyl of about 8 to about 18 carbon atoms; $R_{25}$ is alkyl or substituted alkyl of 1 to 3 carbon atoms or is hydrogen; $R_{26}$ is alkylene or substituted alkylene of 1 to about 4 carbon atoms; $Z_2$ is carboxy, sulfonate, sulfate, phosphate, or phosphonate; and $Me_1$ is a salt-forming cation. Examples of compounds of this type include sodium 3-(dodecylamino)-propionate; sodium 3-(dodecylamino)propane-1-sulfonate; sodium 2-(dodecylamino)ethyl sulfate; sodium 3-(hexadecylamino)propane-1-phosphonate; N alkyl taurines such as the ones prepared by reacting dodecylamine with sodium isethionate according to the teaching of U.S. Pat. No. 2,658,072; sodium salts of N-higher alkyl aprotic acids such as those produced according to the teaching of U.S. Pat. No. 2,438,091 and products sold under the trade name "Miranol" and described in U.S. Pat. No. 2,528,378.

Of all the above-described types of zwitterionic surfactants, preferred compounds include 3(N,N-dimethyl-N-alkylammonio)-propane-1-sulfonate and 3(N,N-dimethyl-N-alkylammonio)-2-hydroxypropane-1-sulfonate wherein in both compounds the alkyl group averages 14.8 carbon atoms in length; 3(N,N-dimethyl-N-hexadecylammonio)-propane-1-sulfonate; 3(N,N-dimethyl-N-hexadecylammonio)-2-hydroxypropane-1-sulfonate; 3-(N-dodecylbenzyl-N,N-dimethylammonio)-propane-1-sulfonate; (N-dodecylbenzyl)-N,N-dimethylammonio)acetate; 3-(N-dodecylbenzyl-N,N-dimethylammonio)propionate; 6-(N-dodecylbenzyl-N,N-dimethylammonio)hexanoate; 6-(N-tetradecylbenzyl-N,N-dimethylammonio)hexanoate; 6-(N-hexadecylbenzyl-N,N-dimethylammonio)hexanoate; and (N,N-dimethyl-N-hexadecylammonio)acetate.

Zwitterionic surfactant is present in the instant dye transfer inhibition compositions to the extent of from about 2% to about 75% by weight, preferably from about 4% to 24% by weight. In washing solution the zwitterionic surfactant should be employed in an amount sufficient to provide from about 0.01% to about 0.06% by weight of said zwitterionic surfactant in solution.

Optional Components

The above-described four-component compositions will in an aqueous solution inhibit the transfer of solubilized or suspended dyes from one fabric to another within such solution. Such compositions are, however, not by themselves satisfactory fabric laundering compositions and hence in practice are generally utilized in conjunction with detergent formulations which will remove fabric soil and stains. Thus in actual use, the above-described four-component compositions are generally either (1) added to a laundering solution which contains conventional detergent formulations or (2) utilized as one portion of a laundering composition containing conventional detergent components.

Most essential of such detergent formulation components and hence a most preferred optional component for compositions of the instant invention is an additional surfactant. The organic surfactant compounds which can be utilized as optional components in the compositions of this invention are anionic and nonionic surfactants and mixtures thereof present to the extent of from about 2% to 30% by weight. Such surfactants are exemplified as follows:

Anionic Surfactants

Anionic surfactants are those compounds which in aqueous solution yield a negatively charged surface-active ion. Anionic surfactants fall into two broad classes known as soaps and anionic synthetic non-soap detergents. Soaps are the sodium, potassium, ammonium and alkanolammonium salts of higher fatty acids containing from about 10 to 22 carbon atoms. Examples of soaps are the sodium and potassium salts of the mixture of fatty acids derived from coconut oil and tallow, i.e., sodium and potassium coconut and tallow soap. Anionic synthetic non-soap detergents can be broadly described as the water-soluble salts, particularly the alkali metal salts, of organic sulfuric reaction products having in their molecular structure an alkyl group containing from about 8 to about 22 carbon atoms and a moiety selected from the group consisting of sulfonic acid and sulfuric acid ester moieties. (Included in the term alkyl is the alkyl portion of higher acyl moieties.) Examples of anionic synthetic detergents are the sodium and potassium alkyl sulfates, especially those obtained by sulfating the higher alcohols ($C_8$–$C_{18}$ carbon atoms) produced by reducing the glycerides of tallow or coconut oil; sodium or potassium alkyl benzene sulfonates, in which the alkyl group contains from about 9 to about 15 carbon atoms, including those of the types described in the U.S. Pat. Nos. 2,220,099 and 2,477,383 (the alkyl group can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of higher fatty alcohol (e.g., tallow or coconut oil alcohols) and about 1 to 6 moles of ethylene oxide; sodium or potassium salts of alkyl phenol ethylene oxide ether sulfates with about one to about ten units of ethylene oxide per molecule and in which the alkyl groups contain from 8 to about 12 carbon atoms; the reaction products of fatty acid esterified with isethionic acid and neutralized with sodium hydroxide where, for example, the fatty acids are derived from coconut oil; sodium or potassium salts of fatty acid amides of a methyl chloride in which fatty acids, for example, are derived from coconut oil; and other anionic surfactants known in the art, a number specifically set forth in U.S. Pat. Nos. 2,486,921; 2,486,933; 2,396,278 and 3,332,880.

Preferred anionic surfactants for use in the instant invention include the sodium salt of linear alkyl benzene sulfonic acid wherein the alkyl chain averages 11.8 carbon atoms in length, sodium tallow alkyl sulfate, and sodium tallow alkyl trioxyethylene ether sulfate.

Anionic surfactants tend to interfere with the dye transfer inhibition performance of the instant compositions and for this reason anionic surfactants are not a preferred class of optional surfactant components for use therewith. Some anionic surfactant, however, can be present if high enough concentrations of the zwitterionic surfactant are employed. Generally, when anionic surfactants are employed, the requisite zwitterionic surfactant is employed in an amount sufficient to provide a zwitterionic to anionic surfactant weight ratio greater than about 1.5:1.

If present, the anionic surfactant concentration in compositions of the instant invention generally varies from about 4% to 10% by weight. In washing solution such anionic surfactants are generally present in concentrations ranging from about 0.0075% to 0.0175% by weight.

Nonionic Surfactants

A highly preferred class of optional surfactant components for compositions of the instant invention is that of nonionic surfactants. Usually nonionic surfactants are compounds produced by the condensation of an alkylene oxide (hydrophilic in nature) with an organic hydrophobic compound which is usually aliphatic or alkyl aromatic in nature. The length of the hydrophilic or polyoxyalkylene moiety which is condensed with any particular hydrophobic compound can be readily adjusted to yield a water-soluble compound having the desired degree of balance between hydrophilic and hydrophobic elements. Another type of nonionic surfactants are the so-called polar nonionics derived from amine oxides, phosphine oxides or sulfoxides. Examples of suitable nonionic surfactants include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to about 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

2 The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

5. Surfactants having the formula $R^1R^2R^3N \rightarrow O$ (amine oxide surfactants) wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and no ether linkages; and each $R_2$ and $R_3$ is selected from the group consisting of alkyl groups and hydroxyalkyl groups containing from 1 to about 3 carbon atoms.

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethytetradecylamine oxide, dipropyldodecylamine oxide, bis-(2-hydroxyethyl)dodecylamine oxide, bis-(2-hydroxyethyl)-3-dodecoxy-1-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds.

6. Surfactants having the formula $R^1R^2R_3 \rightarrow O$ (phosphine oxide surfactants) wherein $R^1$ is an alkyl group containing from about 10 to about 28 carbon atoms, from 0 to about 2 hydroxy groups and from 0 to about 5 ether linkages, there being at least one moiety of $R'$ which is an alkyl group containing from about 10 to about 18 carbon atoms and no ether linkages; and each $R^2$ and $R^3$ is selected from the group consisting of alkyl groups and hydroxyalkyl groups containing from 1 to about 3 carbon atoms.

Specific examples of the phosphine oxide detergents include: dimethyldodecylphosphine oxide, dimethyltetradecylphosphine oxide, ethylmethyltetradecylphosphine oxide, cetyldimethylphosphine oxide, dimethylstearylphosphine oxide, cetylethylpropylphosphine oxide, diethyldodecylphosphine oxide, diethyltetradecylphosphine oxide, dipropyldodecylphosphine oxide, dipropyldodecylphosphine oxide, bis-(hydroxymethyl)dodecylphosphine oxide, bis-(2-hydroxyethyl)-dodecylphosphine oxide, (2-hydroxypropyl)methyltetradecylphosphine oxide, dimethyloleylphosphine oxide, and dimethyl-(2-hydroxydodecyl)phosphine oxide and the corresponding decyl, hexadecyl, and octadecyl homologs of the above compounds.

7. Surfactants having the formula

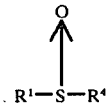

(sulfoxide surfactants) wherein $R^1$ is an alkyl group containing from about 10 to about 28 carbon atoms, from 0 to about 5 ether linkages and from 0 to about 2 hydroxyl substituents, at least one moiety of $R^1$ being an alkyl group containing no ether linkages and containing from about 10 to about 18 carbon atoms, and wherein $R^4$ is an alkyl group containing from 1 to 3 carbon atoms and from zero to two hydroxyl groups. Specific examples of sulfoxide surfactants include octadecyl methyl sulfoxide, dodecyl methyl sulfoxide, tetradecyl methyl sulfoxide, 3-hydroxytridecyl methyl sulfoxide, 3-methoxytridecyl methyl sulfoxide, 3-hydroxy-4-dodecoxybutyl methyl sulfoxide, octadecyl 2-hydroxyethyl sulfoxide, and dodecylethyl sulfoxide.

Of all the above-described types of nonionic surfactants, preferred nonionic surfactants include the condensation product of nonyl phenol with about 9.5 moles of ethylene oxide per mole of nonyl phenol, the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol and the condensation product of a secondary fatty alcohol containing about 13 carbon atoms with about 9 moles of ethylene oxide per mole of fatty alcohol.

The above-described nonionic surfactants can comprise from about 2% to about 30% by weight of the instant dye transfer inhibition compositions. In laundering solutions such surfactants are generally present in a concentration of from about 0.01% to about 0.06% by weight. Builder Compounds Compositions of the instant invention can also optionally contain common detergent builder compounds. Many of the conventional water-soluble builder compounds, either of organic or inorganic type, are compatible with the basic four component dye transfer inhibition combination of the the instant invention. In fact, many materials useful as the above-described Buffer Component also function as detergent builders.

Some common detergent builders are themselves readily oxidized by the activated peroxy bleach combination of the instant invention and hence are not preferred for use in the instant compositions. Those builders (such as nitrilotriacetates) having an oxidizable nitrogen atom fall within this non-preferred class of builder compounds.

Non-limiting examples of suitable water-soluble, inorganic alkaline detergency builder salts are the alkali metal carbonates, borates, phosphates, polyphosphates, pyrophosphates, orthophosphates, metaphosphates, bicarbonates, silicates and sulfates. Specific examples of such salts are the sodium and potassium tetraborates, bicarbonates, carbonates, tripolyphosphates, orthophosphates and hexamethaphosphates.

Examples of suitable organic alkaline detergency builder salts are: (1) water-soluble salts of phytic acid, e.g., sodium and potassium phytates — see U.S. Pat. No. 2,739,942; and (2) water-soluble polyphosphonates, including, specifically, sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include these same alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid.

The polycarboxylate materials described by U.S. Pat. Nos. 2,264,103 and 3,308,067 are also suitably employed herein. For example, aconitric acid, mellitic acid and the penta-and tetra-carboxylic acids prepared by the malonic acid synthesis can be employed herein as builders. The water-soluble alkali metal salts of these materials are also suitable.

Preferred builders for use in the instant compositions include alkali metal tripolyphosphates, carbonates, silicates and sulfates.

Builder compounds can be present in the instant dye transfer inhibition laundering compositions to the extent of about 1% to about 85% by weight. Generally in laundering solution such optional builder compounds are present in a concentration of from about 0.01% to about 0.3% by weight.

Minor Ingredients

In addition to the above-described optional surfactant and builder components, the dye transfer inhibition compositions of the instant invention can also optionally contain any non-interfering ingredients which serve to improve the laundering characteristics of the solutions in which they are dissolved or which add aesthetic appeal to the compositions themselves. Such minor ingredients can include enzymes, brighteners, perfumes, coloring agents, anti-redeposition agents, corrosion inhibitors suds control agents and other filler material. (One such anti-redeposition agent, polyvinylpyrrolidone, actually contributes to the inhibition of dye transfer, and its utilization in this capacity is described more fully in the concurrently-filed copending U.S. Pat. application of J. Paul Jones entitled LAUNDERING AID and having Ser. No. 384,528, filed Aug. 1, 1973, said application being a continuation-in-part of the U.S. Pat. application of J. Paul Jones entitled LAUNDERING AID and having Ser. No. 230,491, filed Feb. 29, 1972 now abandoned.) Generally such minor components (other than surfactants, builders and moisture) comprise no more than about 20% by weight of the instant composition.

Since all components of the instant dye transfer inhibition compositions are available in dry form, or can be placed in a dry form, such compositions are preferably formulated by thoroughly mixing the granular or powdered components together in the appropriate weight percentage concentrations.

The instant invention also relates to a process for inhibiting transfer from one fabric to another of solubilized and suspended dyes encountered during fabric laundering operations involving colored fabrics. Such a process comprises contacting fabrics with a laundering solution containing effective amounts of (A) a peroxygen compound as hereinbefore described, (B) an activator selected as hereinbefore described, (C) a buffering compound sufficient to mainmaintain solution pH within the range of from 7 to 12 as hereinbefore described, (D) a zwitterionic surfactant as hereinbefore described. Preferably the peroxygen compound is present in solution to provide from about 2.5 ppm to about 50 ppm available oxygen, activator is present to the extent of from about 0.001% to 0.05% by weight, zwitterionic surfactant is present to the extent of from about 0.05% to 0.06% by weight, and buffer is present in the laundering solution in such amounts as to maintain the pH within the range of about 8 to about 10.

It should be noted that solutions containing excessive concentrations of the peroxygen compound, ketone, buffer and zwitterionic surfactant tend to damage the colors on fabrics being laundered. For this reason fabrics to be laundered should not be placed in laundering solution until all of the components of the instant invention have been thoroughly dissolved.

The dye transfer inhibition compositions and processes are illustrated by the following examples:

Thirteen concentrated dye transfer inhibiting compositions are prepared or set forth in Examples I–XIII. Solutions of the composition of Example I-XIII at conventional laundering solution concentration provide pH valves as follows: I — 8.5; II — 8.5; III — 8.5; IV — 9.0; V — 8.5; VI — 8.5; VII — 8.5; VIII — 10.2; IX — 10.3; X — 8.5; XI — 8.0; XII — 7.2; and XIII — 7.2.

EXAMPLE I

A dye transfer inhibiting composition is formulated having the following composition:

| Component | Wt. % |
|---|---|
| Oxone* | 15.5 |
| Di-2-pyridyl ketone | 2.9 |
| 3-(N-dodecylbenzyl-N,N-dimethyl-ammonio)propane-1-sulfonate | 11.6 |
| Sodium tripolyphosphate | 70.0 |

*A commercially available composition containing 41.5% by weight potassium monopersulfate, the balance being $KHSO_4$ and $K_2SO_4$ in equal proportions.

Such a composition provides substantial reduction of dye transfer among white and colored fabrics when added to an aqueous laundering solution.

Compositions providing substantially similar dye transfer inhibition are obtained when the Oxone peroxygen compound is replaced with sodium monopersulfate, tetrapotassium peroxydisphosphate, diperazelaic acid, or diperoxyisophthalic acid in a concentration sufficient to provide an equivalent amount of available oxygen; or the di-2-pyridyl ketone activator is replaced with an equivalent amount of p-nitroacetophenone, triacetylbenzene, diacetylbenzene, sodium-p-acetylbenzene sulfonate, 8-hydroxyquinoline, 2-acetylquinoxaline, 2-acetylpryidine, 3-acetylpyridine-N-oxide, 4-trimethylammonioacetophenone nitrate, 4-(N-methylmorpholinio)acetophenone nitrate, 1-methyl-4-piperidone methonitrate, 1-benzyl-4-piperidone methonitrate or 5-benzyl-diethylammonio-2-pentanone nitrate, the zwitterionic surfactant is replaced with an equivalent amount of 3-(N,N-dimethyl-N-hexadecylammonio)butyrate, N,N-bis-(oleylamidopropyl)-N-methyl-N-carboxymethylammonium betaine, 3-(N-dodecylphenyl-N,N-dimethylammonio)propane-1-sulfonate, 3-(N,N-dimethyl-N-alkylammonio)-propane-1-sulfonate wherein the alkyl chain averages about 14.8 carbon atoms in length, 3-(N,N-dimethyl-N-alkylammonio)-2-hydroxypropane-1-sulfonate wherein the alkyl chain averages about 14.8 carbon atoms in length, 3-(N,N-dimethyl-N-hexadecylammonio)-2-hydroxypropane-1-sulfonate, (N-dodecylbenzyl-N,N-dimethylammonio)acetate, 3-(N-dodecylbenzyl-N,N-dimethylammonio)propionate, 6-(N-dodecylbenzyl-N,N-dimethylammonio)hexanoate, sodium-3-(dodecylamino)propionate, 3-(N,N-dimethyl-N-hexadecylammonio)-propane-1-sulfonate, 3-(N-dodecylbenzyl-N,N-dimethylammonio)-3-propane-1-sulfonate, (N,N-dimethyl-N-hexadecylammonio) acetate, 6-(N-tetradecylbenzyl-N,N-dimethylammonio)hexanoate or 6-(N-hexadecylbenzyl-N,N-dimethylammonio)hexanoate, or the sodium tripolyphosphate buffer compound is replaced with an equivalent amount of sodium carbonate, sodium silicate or sodium sulfate.

EXAMPLE II

A dye transfer inhibiting composition is formulated having the following composition:

| Component | Wt. % |
|---|---|
| Condensation product of 6 moles of ethylene oxide with coconut fatty alcohol | 6.00 |
| Dye transfer inhibition composition of Example I | 51.50 |
| Silicate solids | 7.24 |
| Sodium carboxymethylcellulose | 1.00 |
| Perfume | 0.15 |
| Minors ($Na_2SO_4$, suds control agents, water) | Balance |

Such a composition is a stable granular detergent composition which provides excellent fabric laundering with minimal transfer of dye during laundering of dyed fabrics. Compositions providing substantially similar dye transfer inhibition are obtained when the coconut fatty alcohol condensation product is replaced with an equivalent amount of the condensation product of 9.5 moles of ethylene oxide with nonyl phenol, the condensation product of tallow fatty alcohol with about 9 moles of ethylene oxide per mole of tallow fatty alcohol, the condensation product of a secondary fatty alcohol containing about 13 carbon atoms with about 9 moles of ethylene oxide per mole of fatty alcohol, dimethyldodecylamine oxide, dimethyldodecylphosphine oxide or dodecylmethyl sulfoxide; or the Oxone, ketone and zwitterionic dye transfer inhibition components are replaced with the alternative dye transfer inhibition components described in Example I.

Examples of other dye transfer inhibiting laundry detergent compositions follow.

EXAMPLE III

| Component | Wt. % |
|---|---|
| Potassium monopersulfate | 5.76 |
| p-Nitroacetophenone | 1.69 |
| Dimethylhexadecylammonio acetate | 28.1 |
| Condensation product of 6 moles of ethylene oxide with coconut fatty alcohol | 0.34 |
| Sodium salt of linear alkyl benzene sulfonic acid wherein the alkyl chain averages 11.8 carbon atoms in length | 4.25 |
| Sodium tallow alkyl sulfate | 5.19 |
| Sodium tripolyphosphate | 27.8 |
| Minors (suds control agents, hydrotropes, perfume, anti-redeposition agents, coloring agents, moisture, etc.) | Balance |

EXAMPLE IV

| Component | Wt. % |
|---|---|
| Potassium monopersulfate | 6.79 |
| p-Nitroacetophenone | 1.99 |
| Dimethylhexadecyl ammonio propane sulfonate | 6.62 |
| Condensation product of 11 moles of ethylene oxide with tallow fatty alcohol | 6.63 |
| Sodium tripolyphosphate | 43.7 |
| Sodium carbonate | 4.70 |
| Polyvinylpyrrolidone | 9.93 |
| Minors (suds control agents, hydrotropes, perfume, anti-redeposition agents, coloring agents, moisture, etc.) | Balance |

EXAMPLE V

| Components | Wt. % |
|---|---|
| Potassium monopersulfate | 5.82 |
| Di-2-pyridyl ketone | 0.57 |
| Dimethylhexadecylammonio acetate | 28.4 |
| Condensation product of 6 moles of ethylene oxide with coconut | 0.34 |

-continued

| Components | Wt. % |
|---|---|
| fatty alcohol | |
| Sodium salt of linear alkyl benzene sulfonic acid wherein the alkyl chain averages 11.8 carbon atoms in length | 4.30 |
| Sodium tallow alkyl sulfate | 5.25 |
| Sodium tripolyphosphate | 28.1 |
| Minors (suds control agents, hydrotropes, perfume, antiredeposition agents, coloring agents, moisture, etc.) | Balance |

EXAMPLE VI

| Component | Wt. % |
|---|---|
| Potassium monopersulfate | 5.82 |
| 4-(N-methylmorpholinio)-acetophenone nitrate | 0.57 |
| Dimethylhexadecylammonio acetate | 28.4 |
| Condensation product of 6 moles of ethylene oxide with coconut fatty alcohol | 0.34 |
| Sodium salt of linear alkyl benzene sulfonic acid wherein the alkyl chain averages 11.8 carbon atoms in length | 4.30 |
| Sodium tallow alkyl sulfate | 5.25 |
| Sodium tripolyphosphate | 28.1 |
| Minors (suds control agents, hydrotropes, perfume, anti-redeposition agents, coloring agents, moisture, etc.) | Balance |

EXAMPLE VII

| Component | Wt. % |
|---|---|
| Potassium monopersulfate | 5.66 |
| p-Diacetylbenzene | 3.31 |
| Dimethylhexadecylammonio acetate | 27.6 |
| Condensation product of 6 moles of ethylene oxide with coconut fatty alcohol | 0.33 |
| Sodium salt of linear alkyl benzene sulfonic acid wherein the alkyl chain averages 11.8 carbon atoms in length | 4.18 |
| Sodium tallow alkyl sulfate | 5.10 |
| Sodium tripolyphosphate | 27.4 |
| Minors (suds control agents, hydrotropes, perfume, anti-redeposition agents, coloring agents, moisture, etc.) | Balance |

EXAMPLE VIII

| Components | Wt. % |
|---|---|
| Potassium monopersulfate | 6.09 |
| Di-2-pyridyl ketone | 2.73 |
| Dimethylhexadecyl ammonio propane sulfonate | 14.9 |
| Sodium tripolyphosphate | 29.7 |
| Sodium carbonate | 29.7 |
| Minors (suds control agents, hydrotropes, perfume, anti-redeposition agents, coloring agents, moisture, etc.) | Balance |

EXAMPLE IX

| Components | Wt. % |
|---|---|
| Potassium monopersulfate | 6.28 |
| Di-2-pyridyl ketone | 2.82 |

-continued

| | |
|---|---|
| Dimethylhexadecyl ammonio propane sulfonate | 12.3 |
| Sodium tripolyphosphate | 30.6 |
| Sodium carbonate | 30.6 |
| Minors (suds control agents, hydrotropes, perfume, anti-redeposition agents, coloring agents, moisture, etc.) | Balance |

EXAMPLE X

| Component | Wt. % |
|---|---|
| Potassium monopersulfate | 4.56 |
| 5-Diethylbenzylammonio-2-pentanone nitrate | 22.2 |
| Dimethylhexadecylammonio acetate | 22.2 |
| Condensation product of 6 moles of ethylene oxide with coconut fatty alcohol | 0.27 |
| Sodium salt of linear alkyl benzene sulfonic acid wherein the alkyl chain averages 11.8 carbon atoms in length | 3.36 |
| Sodium tallow alkyl sulfate | 4.11 |
| Sodium tripolyphosphate | 22.0 |
| Minors (suds control agents, hydrotropes, perfume, anti-redeposition agents, coloring agents, moisture, etc.) | Balance |

EXAMPLE XI

| Component | Wt. % |
|---|---|
| Potassium monopersulfate | 10.2 |
| Di-2-pyridyl ketone | 0.50 |
| Dimethylhexadecylammonio acetate | 24.9 |
| Condensation product of 6 moles of ethylene oxide with coconut fatty alcohol | 0.30 |
| Sodium salt of linear alkyl benzene sulfonic acid wherein the alkyl chain averages 11.8 carbon atoms in length | 3.76 |
| Sodium tallow alkyl sulfate | 4.60 |
| Sodium tripolyphosphate | 24.6 |
| Minors (suds control agents, hydrotropes, perfume, anti-redeposition agents, coloring agents, moisture, etc.) | Balance |

EXAMPLE XII

| Component | Wt. % |
|---|---|
| Diperazelaic acid | 9.04 |
| 4-(N-methylmorpholinio)-acetophenone nitrate | 0.60 |
| Dimethylhexadecylammonio acetate | 30.2 |
| Condensation product of 6 moles of ethylene oxide with coconut fatty alcohol | 0.36 |
| Sodium salt of linear alkyl benzene sulfonic acid wherein the alkyl chain averages 11.8 carbon atoms in length | 4.55 |
| Sodium tallow alkyl sulfate | 5.57 |
| Sodium tripolyphosphate | 25.2 |
| Sodium carbonate | 4.6 |
| Minors (suds control agents, hydrotropes, perfume, anti-redeposition agents, coloring agents, moisture, etc.) | Balance |

EXAMPLE XIII

| Component | Wt. % |
|---|---|
| Diperazelaic acid | 8.77 |
| p-Diacetylbenzene | 3.51 |
| Dimethylhexadecyl ammonio propane sulfonate | 29.2 |
| Condensation product of 6 moles of ethylene oxide with coconut fatty alcohol | 0.35 |
| Sodium salt of linear alkyl benzene sulfonic acid wherein the alkyl chain averages 11.8 carbon atoms in length | 4.42 |
| Sodium tallow alkyl sulfate | 5.40 |
| Sodium tripolyphosphate | 24.6 |
| Sodium carbonate | 4.3 |
| Minor (suds control agents, hydrotropes, perfume, anti-redeposition agents, coloring agents, moisture, etc.) | Balance |

Dye Transfer Testing

Several of the compositions of the preceding Examples were tested for their ability to inhibit dye transfer. Dyed fabrics and white tracer fabrics were "washed" together in aqueous solution containing the components of the instant compositions in concentrations which correspond to those obtained when the solid compositions of the Examples are dissolved for standard laundering operations. A Gardner Color Difference Meter was used to measure pickup by the tracer fabrics of dye released into solutions by the dyed fabrics. The dyed fabrics employed are shown in Table 6.

Table 6

| Dye Type | Color | Fabric | Wt. (gms.) |
|---|---|---|---|
| Acid | Blue | Wool, double knit | 3.8 |
| Azoic | Red | Cotton | 1.6 |
| Azoic | Orange | Cotton | 1.6 |
| Direct | Green | Sweatshirt | 1.0 |
| Direct | Yellow | Sweatshirt | 3.2 |
| Direct | Blue | Sweatshirt | 3.2 |
| Direct | Maroon | Sweatshirt | 4.2 |
| Disperse | Pink | Polyester, double knit | 0.5 |
| Disperse | Pink | Polyester, double knit | 0.5 |
| Disperse | Blue | 91% Arnel triacetate 9% Nylon knit | 2.0 |
| Disperse | Red | 91% Arnel triacetate 9% Nylon knit | 2.0 |
| Fiber Reactive | Purple | Cotton | 0.4 |
| Fiber Reactive | Yellow | Cotton | 0.4 |
| Fiber Reactive | Blue | Cotton | 0.4 |
| Vat | Purple | Terry cloth | 3.4 |
| Vat | Blue | Denim | 3.4 |
| | | Total | 31.6 gms. |

The white tracer fabrics employed were 3½ × 3½ inch swatches obtained from Testfabrics, Inc., and are characterized as shown in Table 7.

Table 7

Multifiber Strip
Cotton Terrycloth
Cotton 80 × 80 print cloth
Polyester/cotton/65/35 blend
Orlon
Dacron, spun
Nylon, double knit
Nylon, spun
Acetate taffeta
Silk crepe
Polyester continuous filament Total Weight 14 gms.

Dyed and tracer fabrics were placed in a 1 liter mini-washer and various loads were washed for 10, 20, 30 and 40 minutes at 105° F and 140° F for each solution tested. For all testing water at 7 grains/gallon hardness was employed with pH being maintained between 9.3 and 9.5. After each run the whiteness of the cotton terrycloth tracer swatches and the double knit Nylon tracer swatches was ascertained using a Gardner Color Difference Meter. "Whiteness" (W) was calculated according to the following formula:

$$W = 100 - \sqrt{(100-L)^2 + 2.3^2(a^2 + b^2)}$$

wherein $L$, $a$ and $b$ are the Gardner Meter lightness and chromaticity coordinates. Meter readings were made using a single layer thickness of fabric and white standardization and backup plates.

Effectiveness of a particular dye transfer inhibition system was measured by establishing a parameter called the Percent of Dye Transfer Reduction (%DTR) utilizing the above-defined whiteness values. %DTR measures the improvement in dye transfer inhibition realized by the system being tested over that occuring when the dyed and tracer fabrics are washed together in a solution containing a commercial granular build detergent, Tide, from which fluorescers had been removed. Thus $$\% DTR = \frac{W_{Test} - W_{FFD}}{W_{FF} - W_{FFD}} \times 100$$

wherein % DTR is Percent Dye Transfer Reduction; $W_{FFD}$ is the Gardner Meter Whiteness of tracer cloths washed with the dyed fabrics in fluorescer-free Tide; $W_{Test}$ is the Gardner Meter Whiteness of tracer cloths washed with the dyed fabrics in the composition being tested; and $W_{FF}$ is the Gardner Meter Whiteness of tracer cloths washed by themselves in fluorescer-free Tide.

Dye transfer performance of various solutions simulating aqueous solutions of compositions of the instant invention is demonstrated by Table 8. The first column identifies the solution being tested. Solution iii is 0.180% by weight of the composition of Example III (pH=8.5); solution iv is 0.153% by weight of the composition of Example IV (pH=9.0); solution v is 0.177% by weight of the composition of Example V (pH=8.5); solution vi is 0.177% by weight of the composition of Example VI (pH=8.5). The next column provides the Percent Dye Transfer Reduction (%DTR) as defined above obtained for the cotton terrycloth tracer material at both 105° F and 140° F (expressed as an average of the % DTR obtained for the 10, 20, 30 and 40 minute wash periods). The next column provides this same data for the double knit Nylon tracer cloth.

Table 8

| Solution | % DTR Cotton | | % DTR Nylon | |
|---|---|---|---|---|
| | 105° F | 140° F | 105° F | 140° F |
| iii | 38 | 22 | 56 | 43 |
| iv | 56 | 13 | 61 | 46 |
| v | 42 | 23 | 69 | 49 |
| vi | 49 | 27 | 65 | 37 |

The Table 8 data demonstrate the dye transfer inhibition efficacy of compositions of the instant invention in both anionic and nonionic formulations, for both cotton and Nylon fabric types, at varying wash water temperatures with a variety of ketone activator compounds.

A similar dye transfer inhibition test was carried out employing a different bundle of dyed fabrics. For this experiment the dyed fabrics utilized are shown in Table 9.

Table 9

| Dye Type | Color | Dyed Fabrics Fabric | Wt. (gms.) |
|---|---|---|---|
| Acid | Blue | Wool, double knit | 5.0 |
| Azoic | Red | Cotton | 5.0 |
| Direct | Maroon | Sweatshirt | 5.0 |
| Disperse | Blue | 91% Arnel triacetate 9% Nylon knit | 3.0 |
| Fiber Reactive | Blue | Sweatshirt | 5.0 |
| Vat | Blue | Denim | 5.0 |
| | | Total | 28.0 gms. |

The tracer fabrics load was identical to that described in Table 7. For this experiment fabric loads were washed for 10 minutes at various temperatures with all other test conditions and procedures corresponding to those described above. The Percent Dye Transfer Reduction was calculated as before and these resulting dye transfer inhibition measurements are illustrated in Table 10. Solution vii is 0.183% by weight of the composition of Example VII (pH=8.5); solution viii is 0.170% by weight of the composition of Example VIII (pH=10.2); solution ix is 0.165% by weight of the composition of Example IX (pH=10.3); solution x is 0.227% by weight of the composition of Example X (pH=8.5); solution xi is 0.203% by weight of the composition of Example XI (pH=8.0).

Table 10

| Solution | Temp (° F) | % DTR Cotton | % DTR Nylon |
|---|---|---|---|
| vii | 80° | 13.5 | 68.4 |
| viii | 80° | 17.7 | 68.2 |
| ix | 105° | 38.7 | 82.7 |
| x | 105° | 5.6 | 68.1 |
| xi | 130° | 31.3 | 74.6 |

Table 10 again illustrates the reduction of dye transfer attained by compositions of the instant invention under various laundering conditions.

What is claimed is:

1. A dye transfer inhibiting composition consisting essentially of:

a. from about 2% to about 75% by weight of a peroxygen compound selected from the group consisting of (1) water-soluble monopersulfates, (2) water-soluble monoperphosphates, (3) organic peroxyacids having the general formula

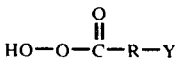

wherein R is selected from the group consisting of alkylene groups containing from about 1 to about 16 carbon atoms and arylene groups containing from about 6 to about 8 carbon atoms, and Y is selected from the group consisting of hydrogen, chlorine, methyl, phenyl,

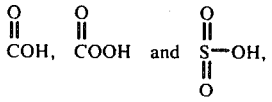

(4) water-soluble salts of said peroxyacids, and (5) mixtures of compounds selected from groups (1) through (4);

b. from about 0.2% to 40% by weight of an activator compound selected from the group consisting of aldehydes, ketones, and compounds which yield aldehydes or ketones in aqueous solution, said activator producing a Relative Oxidation Constant of 0.25 or greater when the peroxygen compound is an inorganic persalt and a Relative Oxidation Constant of 25.0 or greater when the peroxygen compound is an organic peracid;

c. from about 2% to about 75% by weight of a zwitterionic surfactant which is a member selected from the group consisting of derivatives of: secondary amines; tertiary amines; heterocyclic secondary and tertiary amines; quaternary ammonium; quaternary phosphonium; and tertiary sulfonium compounds;

d. from about 1% to about 85% of a buffering compound capable of maintaining the pH of an aqueous solution of said dye transfer inhibiting composition within the range of from about 7 to about 12.

2. A composition in accordance with claim 1 wherein the peroxygen compound is selected from the group consisting of sodium monopersulfate and potassium monopersulfate.

3. A composition in accordance with claim 1 wherein the activator compound is selected from the group consisting of aldehydes, ketones, and compounds producing aldehydes or ketones in aqueous solution; wherein the activator produces a Relative Oxidation Constant of 5.0 or greater when the peroxygen compound is an inorganic persalt and a Relative Oxidation Constant of 200 or greater when the peroxygen compound is an organic peracid.

4. A composition in accordance with claim 1 wherein the activator compound is selected from the group consisting of di-2-pyridyl ketone, p-nitroacetophenone, and triacetylbenzene.

5. A composition in accordance with claim 1 wherein the zwitterionic surfactant is selected from the group consisting of 3-(N,N-dimethyl-N-alkylammonio)-propane-1-sulfonate wherein the alkyl chain averages about 14.8 carbon atoms in length, 3-(N,N-dimethyl-N-alkylammonio)-2-hydroxypropane-1-sulfonate wherein the alkyl chain averages about 14.8 carbon atoms in length, 3-(N,N-dimethyl-N-hexadecylammonio)-propane-1-sulfonate, 3-(N,N-dimethyl-N-hexadecylammonio)-2-hydroxypropane-1-sulfonate, 3-(N-dodecylbenzyl-N,N-dimethylammonio)-propane-1-sulfonate, (N-dodecylbenzyl-N,N-dimethylammonio)acetate, 3-(N-dodecylbenzyl-N,N-dimethylammonio)propionate, 6-N-dodecylbenzyl-N,N-dimethylammonio)-hexanoate, (N,N-dimethyl-N-hexadecylammonio)acetate, 6-(N-tetradecylbenzyl-N,N-dimethylammonio) hexanoate, and 6-(N-hexadecylbenzyl-dimethylammonio)hexanoate.

6. A composition in accordance with claim 1 wherein the said buffer is capable of maintaining an aqueous solution of the said dye transfer inhibiting composition within the range of from about 8 to about 10.

7. A composition in accordance with claim 1 wherein the peroxygen compound is potassium monopersulfate present to the extent of from about 3% to 15% by weight; the activator is selected from the group consisting of di-2-pyridyl ketone, p-nitro-acetophenone, and triacetylbenzene and is present to the extent of from about 0.3% to 5% by weight; the zwitterionic surfactant is selected from the group consisting of 3-(N,N-dimethyl-N-alkylammonio)-propane-1-sulfonate in which the alkyl group averages about 14.8 carbon atoms in length, 3-(N,N-dimethyl-N-alkylammonio)-2-hydroxypropane-1-sulfonate in which the alkyl group averages about 14.8 carbon atoms in length, 3-(N,N-dimethyl-N-hexadecylammonio)-propane-1-sulfonate, 3-(N,N-dimethyl-N-hexadecylammonio)-2-hydroxypropane-1-sulfonate, 3-(N-dodecylbenzyl-N,N-dimethylammonio)-propane-1-sulfonate, (N-dodecylbenzyl-N,N-dimethylammonio)acetate, 3-(N-dodecylbenzyl-N,N-dimethylammonio)propionate, 6-(N-dodecylbenzyl-N,N-dimethylammonio)-hexanoate, (N,N-dimethyl-N-hexadecylammonio)acetate, 6-(N-tetradecylbenzyl-N,N-dimethylammonio)hexanoate, and 6-(N-hexadecylbenzyldimethylammonio)hexanoate and is present to the extent of from about 4% to about 25% by weight; and the buffer compound is selected from the group consisting of sodium bicarbonate, sodium carbonate, disodium hydrogen phosphate, sodium tripolyphosphate or mixtures thereof and is present in an amount sufficient to maintain the pH of an aqueous solution of the said peroxygen compound, said activator, and said zwitterionic surfactant within the range of about 8 to about 10.

8. A dye transfer inhibiting detergent composition consisting essentially of:

a. from about 2% to about 75% by weight of a peroxygen compound selected from the group consisting of (1) water-soluble monopersulfates, (2) water-soluble monoperphosphates, (3) organic peroxyacids having the general formula

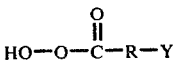

wherein R is selected from the group consisting of alkylene groups containing from about 1 to about 16 carbon atoms and arylene groups containing from about 6 to about 8 carbon atoms, and Y is selected from the group consisting of hydrogen, chlorine, methyl, phenyl,

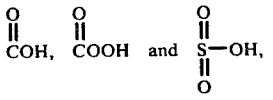

(4) water-soluble salts of said peroxyacids, and (5) mixtures of compounds selected from groups (1) through (4);

b. from about 0.2% to 40% by weight of an activator compound selected from the group consisting of aldehydes, ketones, and compounds which yield aldehydes or ketones in aqueous solution, said activator producing a Relative Oxidation Constant of 0.25 or greater when the peroxygen compound is an inorganic persalt and a Relative Oxidation Constant of 25.0 or greater when the peroxygen compound is an organic peracid;

c. from about 2% to about 75% by weight of a zwitterionic surfactant which is a member selected from the group consisting of derivatives of: secondary amines; tertiary amines; heterocyclic secondary and tertiary amines; quaternary ammonium; quaternary phosphonium; and tertiary sulfonium compounds;

d. from about 1% to about 85% by weight of a buffer compound capable of maintaining the pH of an aqueous solution of the said dye transfer inhibiting detergent composition from about 7 to about 12, said buffer being a compound useful as a detergent composition builder compound;

e. from about 2% to about 30% by weight of an additional organic detersive surfactant selected from the group consisting of anionic and nonionic surfactants.

9. A composition in accordance with claim 8 wherein the additional surfactant is a nonionic surfactant and the buffer compound is selected from the group consisting of alkali metal tripolyphosphates, alkali metal carbonates; alkali metal silicates and alkali metal sulfates.

10. A composition in accordance with claim 9 wherein the peroxygen compound is selected from the group consisting of sodium monopersulfate and potassium monopersulfate.

11. A composition in accordance with claim 9 wherein the activator compound is selected from the group consisting of aldehydes, ketones, and compounds producing aldehydes or ketones in aqueous solution, wherein the activator produces a Relative Oxidation Constant of 5.0 or greater when the peroxygen compound is an inorganic persalt and a Relative Oxidation Constant of 200 or greater when the peroxygen compound is an organic peracid.

12. A composition in accordance with claim 9 wherein the ketone compound is selected from the group consisting of di-2-pyridyl ketone, p-nitroacetophenone, and triacetylbenzene.

13. A composition in accordance with claim 9 wherein the zwitterionic surfactant is selected from the group consisting of 3-N,N-dimethyl-N-alkylammonio)-propane-1-sulfonate wherein the alkyl chain averages about 14.8 carbon atoms in length, 3-(N,N-dimethyl-N-alkylammonio)-2-hydroxypropane-1-sulfonate wherein the alkyl chain averages about 14.8 carbon atoms in length, 3-(N,N-dimethyl-N-hexadecylammonio)-propane-1-sulfonate, 3-(N,N-dimethyl-N-hexadecylammonio)-2-hydroxypropane-1-sulfonate, 3-(N-dedecylbenzyl-N,N-dimethylammonio)-propane-1-sulfonate, (N-dodecylbenzyl-N,N-dimethylammonio)acetate, 3-(N-dodecylbenzyl-N,N-dimethylammonio)propionate, 6-(N-dodecylbenzyl-N,N-dimethylammonio) hexanoate, (N,N-dimethyl-N-hexadecylammonio)acetate, 6-(N-tetradecylbenzyl-N,N-dimethylammonio)-hexanoate, and 6(N-hexadecylbenzyl-dimethylammonio)hexanoate.

14. A composition in accordance with claim 9 wherein the peroxygen compound is potassium monopersulfate present to the extent of from about 3% to about 15% by weight; the activator is selected from the group consisting of di-2-pyridyl ketone, p-nitroacetophenone and triacetylbenzene and is present to the extent of from about 0.3% to about 5% by weight, and the zwitterionic surfactant is selected from the group consisting of 3-(N,N-dimethyl-N-alkylammonio)propane-1-sulfonate in which the alkyl group averages about 14.8 carbon atoms in length, 3-(N,N-dimethyl-N-alkylammonio)-2-hydroxypropane-1-sulfonate in which the alkyl group averages about 14.8 carbon atoms in length, 3-(N,N-dimethyl-N-hexadecylammonio)-propane-1-sulfonate, 3-(N,N-dimethyl-N-hexadecylammonio)-2-hydroxypropane-1-sulfonate, 3-(N-dodecylbenzyl-N,N-dimethylammonio)-propane-1-sulfonate, (N-dodecylbenzyl-N,N-dimethylammonio)acetate, 3-(N-dodecylbenzyl-N,N-dimethylammonio) propionate, 6-(N-dodecylbenzyl-N,N-dimethylammonio) hexanoate, (N,N-dimethyl-N-hexadecylammonio) acetate, 6-(N-tetradecylbenzyl-N,N-dimethylammonio)hexanoate, and 6-(N-hexadecylbenzyl-dimethylammonio)hexanoate and is present to the extent of from about 4% to about 25% by weight.

15. A composition in accordance with claim 14 wherein the nonionic surfactant is selected from the group consisting of the condensation product of nonyl phenol with about 9.5 moles of ethylene oxide per mole of nonyl phenol, the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol and the condensation product of a secondary fatty alcohol containing about 13 carbon atoms with about 9 moles of ethylene oxide per mole of fatty alcohol.

16. A composition in accordance with claim 8 a. wherein the buffer compound is selected from the group consisting of alkali metal tripolyphosphates, alkali metal carbonates, alkali metal silicates and alkali metal sulfates;

b. wherein the additional surfactant is an anionic surfactant present to the extent of from about 4% to about 10% by weight; said anionic surfactant being selected from the group consisting of sodium linear alkyl benzene sulfonate in which the alkyl group averages about 11.8 carbon atoms in length, sodium tallow alkyl sulfate and sodium tallow alkyl trioxyethylene ether sulfate; and c. wherein the weight ratio of zwitterionic surfactant to anionic surfactant is at least 1.5:1.

17. A composition in accordance with claim 16 wherein the peroxygen compound is potassium monopersulfate present to the extent of from about 3% to about 15% by weight; the activator is selected from the group consisting of di-2-pyridyl ketone, p-nitroacetophenone and triacetylbenzene and is present to the extent of from about 0.3% to about 5% by weight, and the zwitterionic surfactant is selected from the group consisting of 3-(N,N-dimethyl-N-alkylammonio)-propane-1-sulfonate in which the alkyl group averages about 14.8 carbon atoms in length, 3-(N,N-dimethyl-N-alkylammonio)-2-hydroxypropane-1-sulfonate in which the alkyl group averages about 14.8 carbon atoms in length, 3-(N,N-dimethyl-N-hexadecylammonio)-propane-1-sulfonate, 3-(N,N-dimethyl-N-hexadecylammonio)-2-hydroxypropane-1-sulfonate, 3-(N-dodecylbenzyl-N,N-dimethylammonio)-propane-1-sulfonate, (N-dodecylbenzyl-N,N-dimethylammonio)acetate, 3-(N-dodecylbenzyl-N,N-dimethylammonio) propionate, 6-(N-dodecylbenzyl-N,N-dimethylammonio) hexanoate, (N,N-dimethyl-N-hexadecylammonio) acetate, 6-(N-tetradecylbenzyl-N,N-dimethylammonio)hexanoate, and 6-(N-tetradecylbenzyl-N,N-dimethylhexanoate and is present to the extent of from about 4% to about 25% by weight.

* * * * *